US009262953B2

(12) United States Patent
Jeong et al.

(10) Patent No.: US 9,262,953 B2
(45) Date of Patent: Feb. 16, 2016

(54) DISPLAY DEVICE AND DISPLAY PANEL

(71) Applicant: LG Display Co., Ltd., Seoul (KR)

(72) Inventors: Ilgi Jeong, Chungcheongbuk-do (KR); ChongHun Park, Paju-si (KR); Soonll Yun, Paju-si (KR); Hana Jung, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 14/325,160

(22) Filed: Jul. 7, 2014

(65) Prior Publication Data

US 2015/0170982 A1 Jun. 18, 2015

(30) Foreign Application Priority Data

Dec. 13, 2013 (KR) ..... 10-2013-0155573

(51) Int. Cl.
*G09G 3/00* (2006.01)
*G09G 3/32* (2006.01)

(52) U.S. Cl.
CPC ..... *G09G 3/006* (2013.01); *G09G 3/3225* (2013.01); *G09G 2300/0426* (2013.01); *G09G 2330/12* (2013.01)

(58) Field of Classification Search
CPC ... H01L 2924/00; H01L 22/32; H01L 27/124; H01L 2224/48463; H01L 22/34; H01L 27/3276; H01L 24/05; G09G 3/006; G09G 2300/0426; G09G 2330/12; G09G 2300/0408; G09G 2310/0205; G09G 3/3225; G02F 2001/136254; G02F 1/01
See application file for complete search history.

(56) References Cited

U.S. PATENT DOCUMENTS

2004/0233344 A1* 11/2004 Ohgiichi et al. ..... 349/40
2008/0123012 A1* 5/2008 Ohtomo ..... 349/54
2011/0127536 A1* 6/2011 Yoshida et al. ..... 257/59

* cited by examiner

*Primary Examiner* — Yasser A Abdelaziez
*Assistant Examiner* — Farun Lu
(74) *Attorney, Agent, or Firm* — Fenwick & West LLP

(57) ABSTRACT

Disclosed are a display panel in which all or some portions of an inspection pad and an inspection wire for inspection of a panel are formed in the display panel, and a display device.

20 Claims, 11 Drawing Sheets

(A)

(B)

DISPLAY DEVICE AND DISPLAY PANEL

CROSS-REFERENCE TO RELATED APPLICATION

This application claims priority from and the benefit under 35 U.S.C. §119(a) of Korean Patent Application No. 10-2013-0155573, filed on Dec. 13, 2013, which is hereby incorporated by reference for all purposes as if fully set forth herein.

BACKGROUND OF THE INVENTION

1. Field of the Invention

The present invention relates to a display device and a display panel.

2. Description of the Prior Art

As the information society develops, the demand for display devices for displaying an image in various forms has increased, and in recent years, various display devices such as Liquid Crystal Displays (LCDs), Plasma Display Panels (PDPs), and Organic Light Emitting Diode displays (OLEDs) have been utilized. Such display devices include a display panel corresponding to the display device.

The display panel included in the display device may be one of various display panels produced from one substrate. That is, elements, signal lines, or power lines constituting pixels in one substrate are formed in a unit of display panels according to several process procedures, and then a substrate is cut into units of display panels by using scribing equipment to produce several display panels.

During a panel manufacturing process, inspection of panels (for example, aging inspection) for identifying characteristic changes and state of elements and lines constituting pixels in a display panel, and for the inspection of a panel, when, before, or after elements, signal lines, or power lines constituting pixels in units of display panels on a substrate are formed, an inspection pad and an inspection wire for inspection of the panels may be formed together.

The inspection pad and the inspection wire for inspection of the panels are formed substantially at an outer portion of the display panel. Thus, if the substrate is cut into units of display panels by using the scribing equipment, an inspection pad or an inspection wire for inspection of a panel is not left in the display panel.

However, since a separation between areas in which display panels are produced on a substrate is considerably small, it is not easy to form an inspection pad and an inspection wire for inspection of a panel in an outer area of a display panel.

Accordingly, since a separation between areas in which display panels are produced cannot be sufficiently narrowed on a substrate, it is difficult to produce many display panels from one substrate.

SUMMARY OF THE INVENTION

Accordingly, the present invention has been made to solve the above-mentioned problems occurring in the prior art, and an aspect of the present invention is to provide a display panel in which all or some portions of an inspection pad and an inspection wire for inspection of a panel are formed in the display panel, and a display device.

Another aspect of the present invention is to provide a display panel in which all or some portions of an inspection pad and an inspection wire for inspection of a panel are formed in the display panel due to a structure which allows a narrow bezel, and a display device.

Another aspect of the present invention is to provide a display panel in which all or some portions of an inspection pad and an inspection wire for inspection of a panel are formed in the display panel due to a structure which allows a narrow bezel such that panel manufacturing efficiency and yield rate are improved, and a display device.

In accordance with an aspect of the present invention, there is provided a display device including: at least one driver integrated circuit for outputting a signal for display of an image; and a display panel having at least one inspection pad and at least one inspection wire in a peripheral area of an area to which the driver integrated circuit is connected, wherein the at least one inspection wire formed in the peripheral area of the area to which the driver integrated circuit is connected comprises a first inspection wire, opposite ends of which are connected to different inspection pads.

In accordance with another aspect of the present invention, there is provided a display panel including: a first line formed in a first direction; a second line formed in a second direction; and at least one inspection pad and at least one inspection wire in a peripheral area of an area to which the driver integrated circuit is connected.

As described above, according to the related art, a display panel and a display device are configured such that all or some portions of an inspection pad and an inspection wire for inspection of a panel are formed in the display panel.

Further, according to the present invention, a display panel and a display device are configured such that all or some portions of an inspection pad and an inspection wire for inspection of a panel are formed in the display panel due to a structure which allows a narrow bezel.

In addition, according to the present invention, a display panel and a display device are configured such that all or some portions of an inspection pad and an inspection wire for inspection of a panel are formed in the display panel due to a structure which allows a narrow bezel such that panel manufacturing efficiency and yield rate are improved.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE EXEMPLARY EMBODIMENTS

Figure 1:
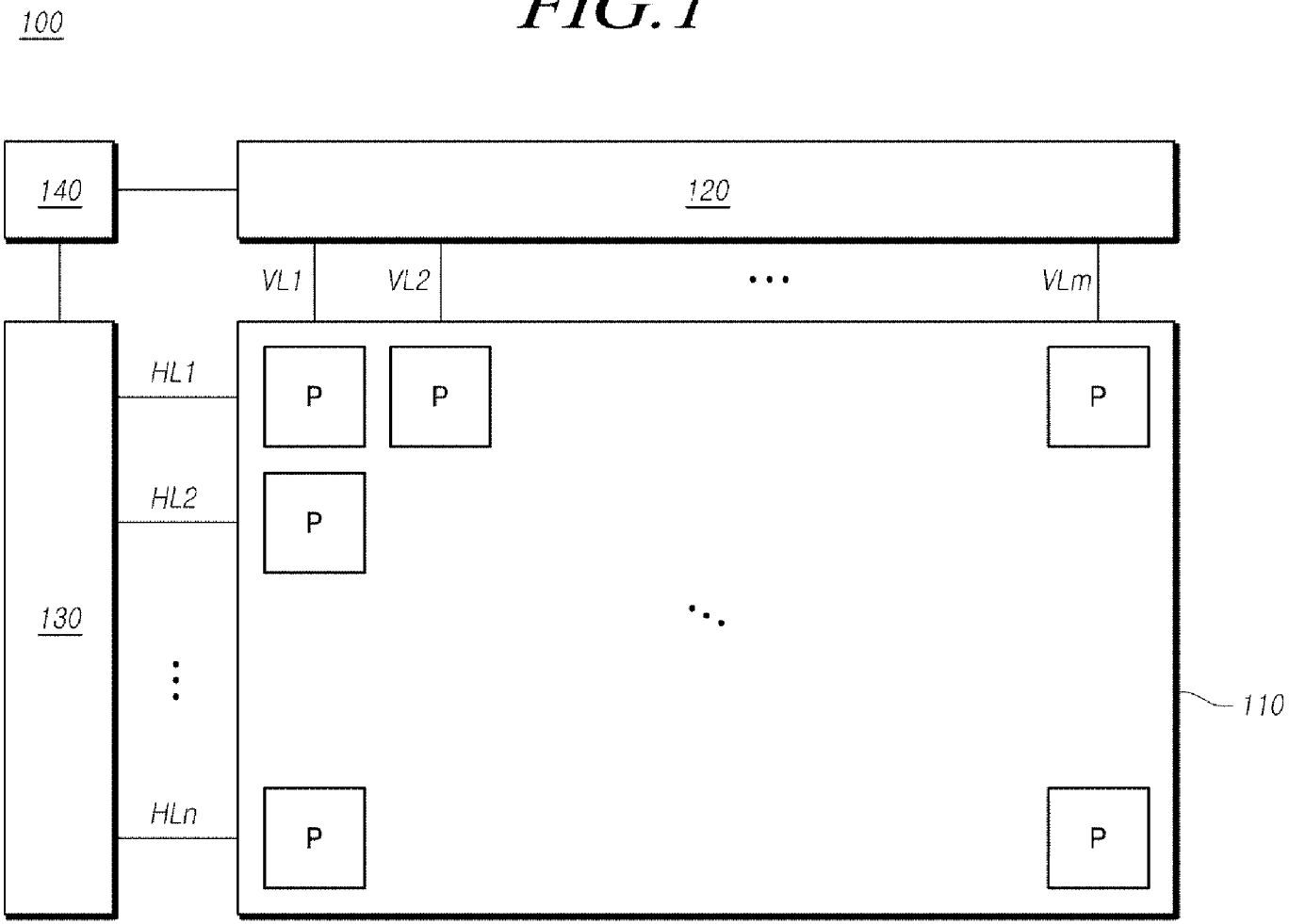
FIG. 1 is a schematic view showing a display device according an embodiment of the present invention.

Hereinafter, exemplary embodiments of the present invention will be described with reference to the accompanying drawings. In providing reference numerals to the constituent elements of the drawings, the same elements may have the same reference numerals even if they are displayed on different drawings. Further, in the following description of the present invention, a detailed description of known functions and configurations incorporated herein will be omitted when it may make the subject matter of the present invention rather unclear.

In addition, terms, such as first, second, A, B, (a), (b) or the like may be used herein when describing components of the present invention. The terms are provided only to distinguish the elements from other elements, and the essences, sequences, orders, and numbers of the elements are not limited by the terms. When it is described that one element is connected, coupled, or jointed to another element, the element may be directly connected or coupled to the other element, but a third element may be interposed between the elements or the element may be connected, coupled, or jointed to the other element through a third element.

FIG. 1 is a schematic view showing a display device 100 according an embodiment of the present invention.

Referring to FIG. 1, the display device 100 according to the embodiment of the present invention includes a display panel 110 in which a plurality of first lines VL1 to VLm are formed in a first direction (for example, a vertical direction) and a plurality of second lines HL1 to HLn are formed in a second direction (for example, a horizontal direction), a first driving unit 120 for supplying a first signal to the plurality of first lines VL1 to VLm, a second driving unit 130 for supplying a second signal to the plurality of second lines HL1 to HLn, and a timing controller 140 for controlling the first driving unit 120 and the second driving unit 130.

A plurality of pixels P are defined in the display panel 110 as the plurality of first lines VL1 to VLm formed in the first direction (for example, a vertical direction) and the plurality of second lines HL1 to HLn formed in the second direction (for example, a horizontal direction) cross each other.

Each of the first driving unit 120 and the second driving unit 130 may include at least one driver integrated circuit (IC) for outputting a signal for display of an image.

The plurality of first lines VL1 to VLm formed in the display panel 110 in the first direction may be, for example, data lines formed in the vertical direction (first direction), for transferring a data voltage (first signal) to vertical rows of pixels, and the first driving unit 120 may be a data driving unit for supplying a data voltage to the data lines.

The plurality of second lines HL1 to HLn formed in the display panel 110 in the second direction may be gate lines formed in the horizontal direction (second direction), for transferring a scan signal (first signal) to horizontal rows of pixels, and the second driving unit 130 may be a gate driving unit for supplying a scan signal to the gate lines.

Meanwhile, in relation to a process of manufacturing the display panel 110, a plurality of display panels 110 are manufactured from a large-sized substrate at the same time and an inspection of the plurality of display panels 110 are performed in the panel manufacturing process. Thus, the display panels 110 included in the display device 100 are cut into units of display panels after several inspections in the process of manufacturing display panels.

Here, the inspection is a process of identifying a state of the display panel 110, and for example, may be an aging inspection for applying an aging signal to pixels in the display panel 110 and identifying characteristics changes, states, and the like of the elements forming the pixels in the display panel 110, the first lines VL1 to VLm, and the second lines HL1 to HLn formed in the display panel 110.

For this inspection, in the display panel manufacturing process, an inspection pad and an inspection wire which are not used to drive the finally finished display panel 110 but are used for an inspection are formed on a large-sized substrate together.

The inspection pad and the inspection wire formed for an inspection performed in the display panel manufacturing process acts as an obstruction factor against an increase of the yield rate of the display panel 110 and a reduction of a bezel of the display panel 110.

Thus, in the embodiment of the present invention, an inspection pad and inspection wire structure for increasing the yield rate of a display panel 110 and reducing the size of a bezel are suggested, and a display device 110 manufactured after inspection is performed according to the suggested inspection pad and inspection wire structure and a display device 100 including the same are disclosed.

Hereinafter, several embodiments of the display panel 110 which has been manufactured after inspection through a display panel manufacturing process will be described. Thereafter, an inspection process performed when the display panel 110 is manufactured and an inspection structure (a structure of an inspection pad and an inspection wire) for the inspection process will be described.

Figure 2:
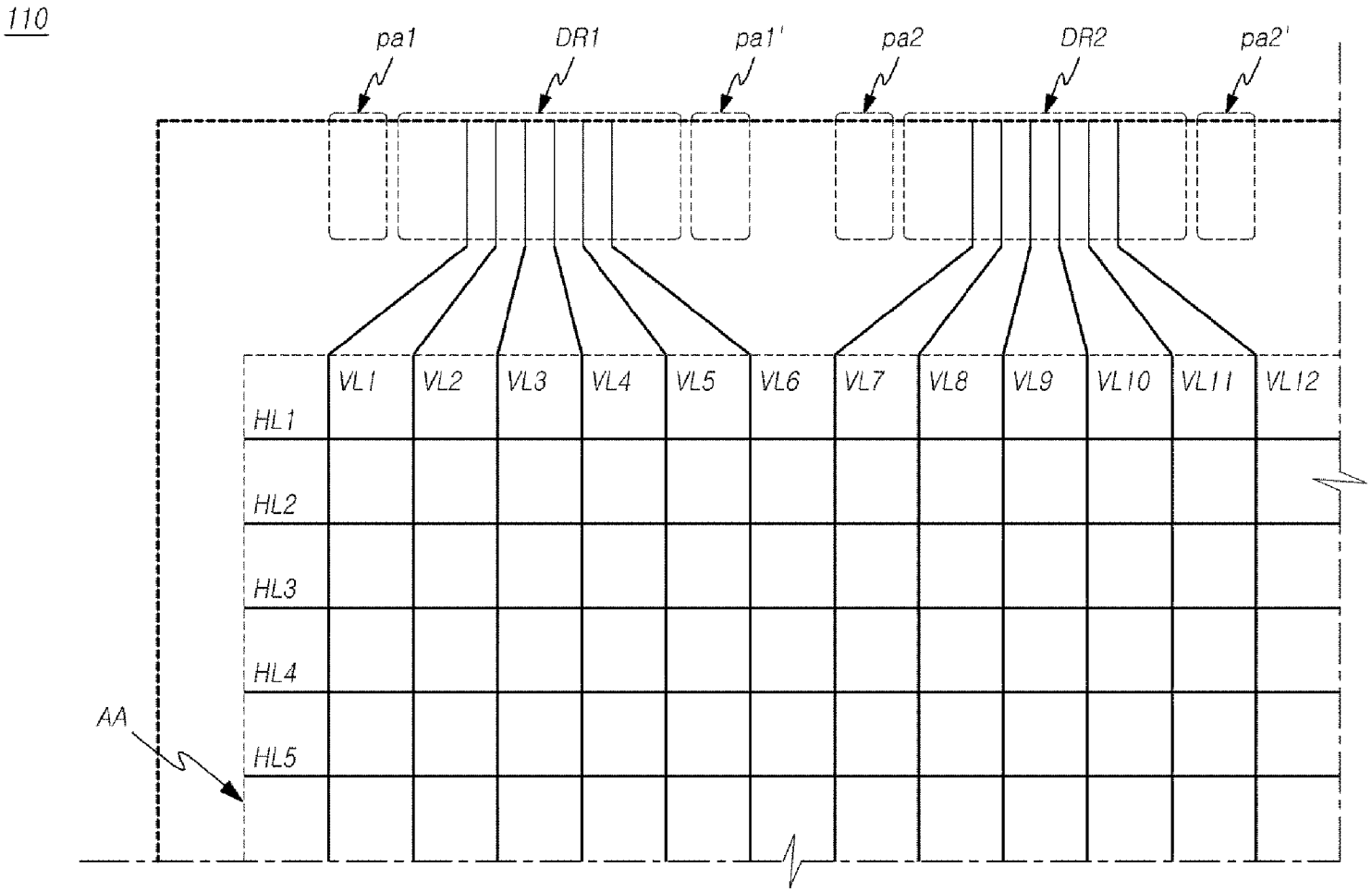
FIG. 2 is a schematic view showing a display panel according an embodiment of the present invention.

FIG. 2 is a schematic view showing a display panel according an embodiment of the present invention. Meanwhile, FIG. 2 is a view showing a portion (a upper left end portion) of the display panel 110 according to the embodiment of the present invention.

Referring to FIG. 2, the display panel 110 according to the embodiment of the present invention is configured such that first lines VL1 to VLm are formed in a first direction, second lines HL1 to HLn are formed in a second direction, and at least one inspection pad and at least one inspection wire are formed in peripheral areas pa1, pa1', pa2, pa2', etc. of areas DR1, DR2, etc. to which driver ICs for outputting a signal to the first lines VL1 to VLm formed in the first direction.

Here, the at least one inspection pad and the at least one inspection wire formed in the peripheral areas pa1, pa1', pa2, pa2', etc. of the areas DR1, DR2, etc. to which the driver integrated circuits (ICs) are connected are initially formed in the substrate to be used for an inspection of a panel during a panel manufacturing process and are left after the process of manufacturing the display panel 110 (including a scribing process).

Referring to FIG. 2, the display panel 110 includes an active area AA corresponding to a display area and a non-active area (non-display area) corresponding to an outer area of the active area AA. The at least one inspection pad and the at least one inspection wire are formed in the non-active area.

Referring to FIG. 2, in the display panel 110, at least one inspection pad and at least one inspection wire may correspond to opposite sides of the areas DR1 and DR2 to which the driver integrated circuits are connected.

In more detail, referring to FIG. 2, at least one inspection pad and at least one inspection wire may be formed in one area pa1 of the area DR1 to which the first driver integrated circuit is connected, and at least one inspection pad and at least one inspection wire may be formed in an opposite area pa1' of the area DR1 to which the first driver integrated circuit is connected.

At least one inspection pad and at least one inspection wire may be formed in one area pa2 of the area DR2 to which the second driver integrated circuit is connected, and at least one inspection pad and at least one inspection wire may be formed in an opposite area pa2' of the area DR2 to which the second driver integrated circuit is connected.

The at least one inspection wire formed in peripheral areas of the areas DR1, DR2, etc. to which the driver integrated circuits are connected includes a first inspection wire, opposite ends of which are connected to different inspection pads, respectively.

Here, the first inspection wire, opposite ends of which are connected to different inspection pads respectively, is a wire acting as a shorting bar connecting two inspection pads formed in peripheral areas of areas to which other driver integrated circuits are connected.

Due to the first inspection wire, opposite ends of which are connected to different inspection pads, a shorting bar which has been used in the panel inspection structure according to the related art may not be necessary, and integrated inspection wires LA, LB, LC, LD, LE, and LF (see FIG. 11) for an integrated inspection and inspection wires la1 lb 1, lc1, ld1, le1, lf1, la2, lb2, lc2, ld2, le2, and lf2 (see FIG. 11) may be unified. Due to this, a space for forming individual/integrated inspection wires also may be reduced.

The first inspection wire, opposite ends of which are connected to different inspection pads, may be formed on a lower side of locations of the different inspection pads connected to the opposite ends of the first inspection wire. That is, the first inspection wire may be formed between the locations of the different inspection pads and a peripheral location of the active area AA of the display panel 110.

The at least one inspection wire formed in peripheral areas of the areas DR1, DR2, etc. to which the driver integrated circuits are connected may include a second inspection wire (For example, In following FIG. 4, lc1, ld1, le1, lf1, lc1', ld1', le1', lf1', lc2, ld2, le2, lf2, lc2', ld2', le2', lf2'), only one end of which is connected to an inspection pad.

Here, the second inspection wire, only one end of which is connected to the inspection pad, may be formed on an upper side of a location of the connected inspection pad. That is, the second inspection wire may be formed between the location of the connected inspection pad and a corner location of the display panel 110.

One end of the second inspection wire is connected to one inspection pad, and an opposite end of the second inspection wire is broken at a corner of the display panel 110.

A plurality of link lines are formed between the second inspection wires or the inspection pads formed between opposite sides of the areas DR1 and DR2 to which the driver integrated circuits are connected.

Meanwhile, the at least one inspection pad formed at peripheral areas of the areas DR1 and DR2 to which the driver integrated circuits are connected may be an inspection pad to which an inspection wire is connected, and may be an inspection pad to which an inspection wire is not connected according to an embodiment.

That is, all the inspection pads formed in the display panel 110 may be inspection pads to which inspection wires are connected, and may be a combination of inspection pads to which inspection wires are connected and inspection pad to which an inspection wire is not connected. This may be different according to a scribing location during a process of manufacturing the display panel 110, which will be described in detail below.

A plurality of inspection pads are formed at peripheral areas of the areas DR1 and DR2 to which the driver integrated circuits are connected, the plurality of inspection pads formed in peripheral areas of the areas DR1 and DR2 to which the driver integrated circuits are connected may be arranged in a single row or may be arranged in multiple rows.

Referring to FIG. 2, the first driver integrated circuit outputs a corresponding signal to six first lines VL1 to VL6 through link lines, and the second driver integrated circuit outputs a corresponding signal to the six first lines VL7 to VL12 through link lines.

The driver integrated circuits may be, for example, data driver integrated circuits.

In this case, the at least one inspection pad formed in peripheral areas of the areas DR1 and DR2 to which the driver integrated circuits are connected may include at least one of at least one data line inspection pad and at least one power line inspection pad.

The above-mentioned data line inspection pad may be different according to whether the pixels of the display panel 110 are realized by red(R)/green(G)/blue(B) pixels or by red(R)/green(G)/blue(B)/white(W) pixels.

Thus, the at least one data line inspection pad may include, for example, at least one of a plurality of data line inspection pads for inspecting the supply of data voltages through data lines corresponding to a plurality of colors.

For example, the at least one data line inspection pad may include at least one of an inspect pad for inspecting the supply of a data voltage of a data line supplying a data voltage to a red (R) pixel, an inspect pad for inspecting the supply of a data voltage of a data line supplying a data voltage to a green (G) pixel, an inspect pad for inspecting the supply of a data voltage of a data line supplying a data voltage to a blue (B) pixel, and an inspect pad for inspecting the supply of a data voltage of a data line supplying a data voltage to a white (W) pixel.

The above-mentioned power line inspection pad may be different according to structure of pixels of the display panel 110. That is, the power line inspection pad may be different according to which type of power source is used for driving of the pixels.

Thus, the at least one power line inspection pad may include, for example, at least one of two or more power line inspection pads for inspecting the supply of electric power through power lines corresponding to two or more types of power sources.

For example, when the at least one power line inspection pad has a pixel structure (see FIG. 9) to which a driving voltage VDD and a reference voltage Vref should be supplied, the at least one power line inspection pad may include at least one of a power source line for supplying a driving voltage VDD and a power line for supplying a reference voltage Vref.

The at least one inspection pad and the at least one inspection wire in the peripheral areas of the areas to which the driver integrated circuits are connected may be, for example, an inspection pad and an inspection wire for an aging inspection.

Hereinafter, three embodiments of the structure of the above-described display panel 110 (structures of an inspection pad and an inspection wire) will be described.

Figure 3:
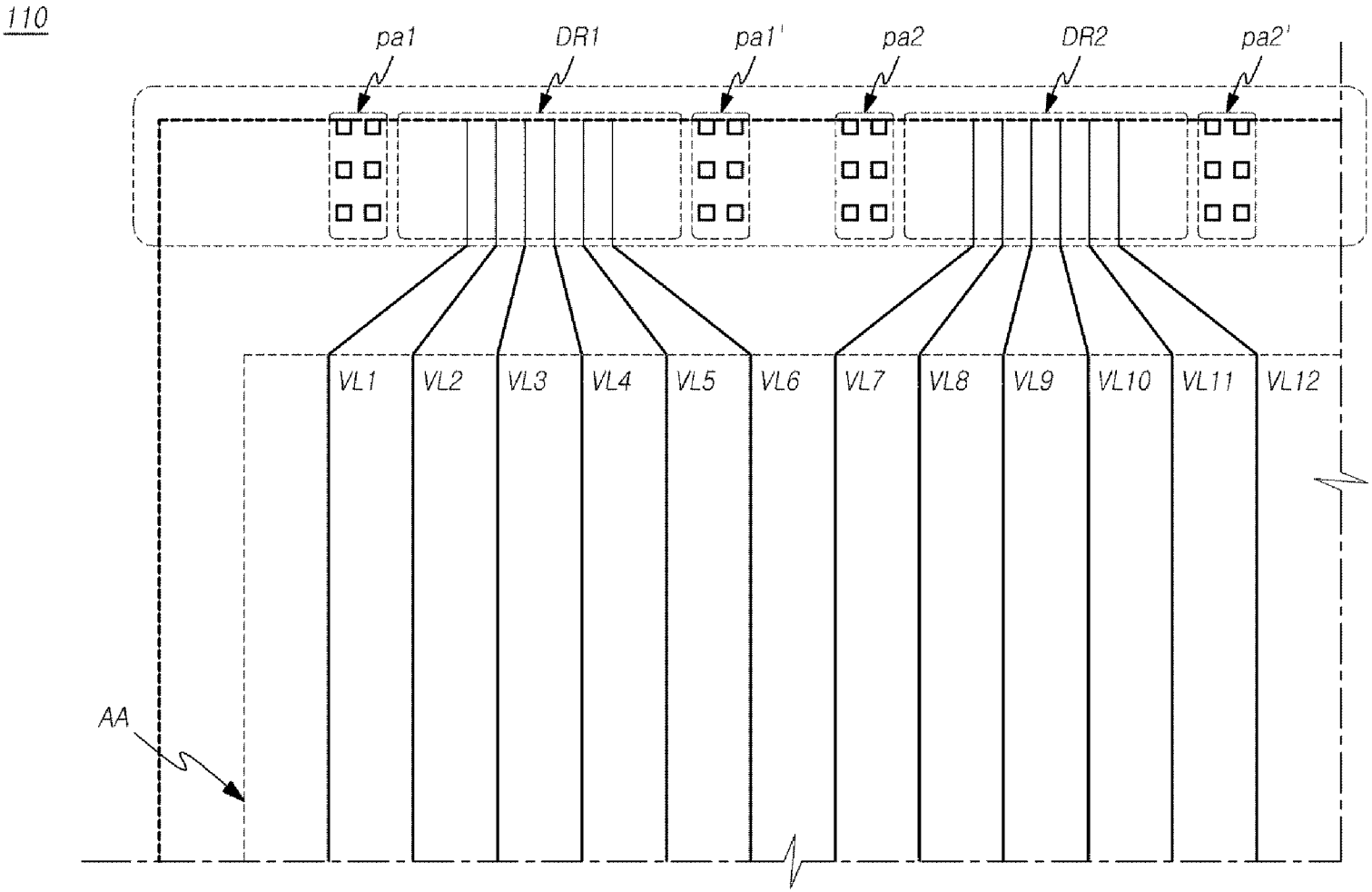
FIGS. 3 and 4 are views showing a display panel according to an embodiment of the present invention.
Figure 4:
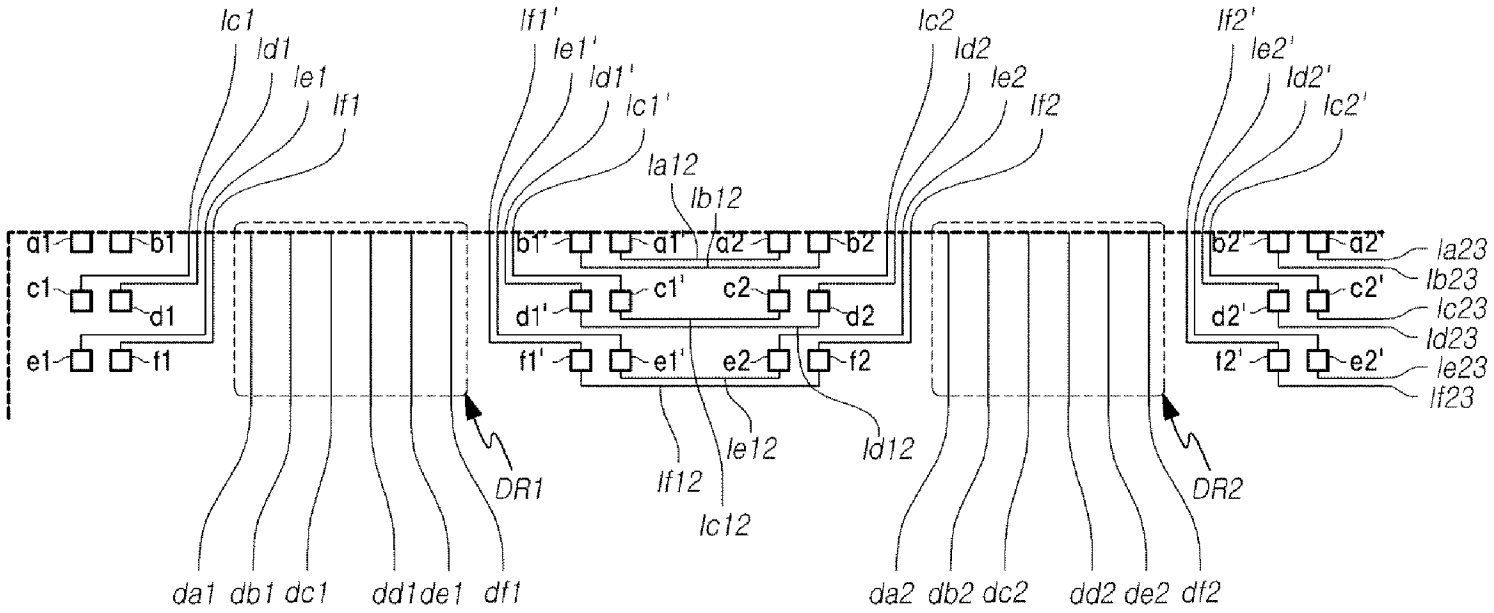

FIG. 3 is a view showing a display panel 110 according to an embodiment of the present invention. FIG. 4 is an enlarged view showing a portion of FIG. 3. However, for the sake of convenience, second lines HL1, HL2, etc. are not shown and only first lines VL1, VL2, etc., formed in a first direction, are shown in FIG. 3.

Referring to FIG. 3, in the display panel 110 according to the embodiment of the present invention, six inspection pads are formed in peripheral areas pa1, pa1', pa2, pa2' of areas DR1 and DR2 to which driver integrated circuits (ICs) for outputting a signal to the first lines VL1 to VLm formed in the first direction are connected.

Inspection wires (for example, In following FIG. 4, la12, lb12, lc12, ld12, le12, lf12, la23, lb23, lc23, ld23, le23, lf23, lc1, ld1, le1, lf1, lc1', ld1', le1', lf1', lc2, ld2, le2, lf2, lc2', ld2', le2', lf2', etc.) may be formed in the display panel 110 in relation to the inspection pads, and the inspection wires may be first inspection wires (the first type of inspection wires) opposite ends of which are connected to different inspection pads, the opposite ends being connected between two inspection pads, and may be second inspection wires (the second type of inspection wires) connected to only one inspection pad, that is, only one end of which is connected to an inspection pad.

Hereinafter, formation of an inspection pad and an inspection wire will be described in more detail with reference to FIG. 4.

First, formation of an inspection pad will be described in more detail.

Referring to FIG. 4, six inspection pads a1, b1, c1, d1, e1, and f1 are formed at one side pa1 of the area DR1 to which the first driver integrated circuit is connected, and six inspection pads a1', b1', c1', d1', e1', and f1' are formed at an opposite side of pa1' the area DR1 to which the first driver integrated circuit is connected.

Referring to FIG. 4, six inspection pads a2, b2, c2, d2, e2, and f2 are formed at one side pa2 of the area DR2 to which the second driver integrated circuit is connected, and six inspection pads a2', b2', c2', d2', e2', and f2' are formed at an opposite side pa2' of the area DR2 to which the second driver integrated circuit is connected.

Referring to FIGS. 3 and 4, all the six inspection pads formed in the peripheral areas of the areas DR1 and DR2 to which the driver integrated circuits are connected may be arranged in a row. In other embodiments, three pairs of inspection pads may be formed to be spaced apart from each other in the first direction (vertical direction) in consideration of the formation space.

The six inspection pads formed in the peripheral areas of the areas DR1 and DR2 to which the driver integrated circuits are connected may be arranged in a single row, but as shown in FIGS. 3 and 4, may be arranged in a multiple rows.

For example, referring to FIG. 4, among the six inspection pads a1, b1, c1, d1, e1, and f1 formed at one side pa of the area DR1 to which the first driver integrated circuit is connected, the inspection pad a1 and the inspection pad b1 are arranged in a first row, the inspection pad c1 and the inspection pad d1 are arranged in a second row spaced apart from the first row, and the inspection pad e1 and the inspection pad f1 are arranged in a third row spaced apart from the second row.

In more detail, in relation to the formation of the inspection wires, referring to FIG. 4, the inspection wires formed in the display panel 110 may be first inspection wire connected between two inspection pads formed at peripheral areas of the areas DR1 and DR2 to which different driver integrated circuits are connected, or may be second inspection wires, only one end of which is connected to an inspection pad.

Next, formation of an inspection wire will be described in more detail.

The inspection wires formed in the display panel 110 may be one of two types including a first inspection wire, opposite ends of which are connected to different inspection pads, and a second inspection wire, only one end of which is connected to an inspection pad.

First, formation of a first inspection wire, opposite ends of which are connected to different inspection pads, will be described in more detail.

Referring to FIG. 4, six first inspection wires la12, lb12, lc12, ld12, le12, and lf12 for connecting six inspection pads a1', b1', c1', d1', e1', and f1' formed at an opposite side pa1' of the area DR1 to which the first driver integrated circuit is connected, and six inspection pads a2, b2, c2, d2, e2, and f2 formed at one side pa2 of the area DR2 to which the second driver integrated circuit is connected are formed.

Further, referring to FIG. 4, six first inspection wires la23, lb23, lc23, ld23, le23, and lf23 for connecting six inspection pads a2', b2', c2', d2', e2', and f2' formed at an opposite side pa2' of the area DR2 to which the second driver integrated circuit is connected, and six inspection pads a3, b3, c3, d3, e3, and f3 formed at one side pa3 of the area DR3 to which the third driver integrated circuit is connected are formed.

The above-described first inspection wires are formed on a lower side of locations of the different pads connected to opposite ends thereof.

Formation of the second inspection wire, only one end of which are connected to an inspection pad will be described in more detail.

Referring to FIG. 4, four second inspection wires lc1, ld1, le1, and lf1 connected to four inspection pads c1, d1, e1, and f1 of the six inspection pads a1, b1, c1, d1, e1, and f1 formed at one side pa1 of the area DR1 to which the first driver integrated circuit is connected are formed.

Referring to FIG. 4, four second inspection wires lc1', ld1', le1', and lf1' connected to four inspection pads c1', d1', e1', and f1' of the six inspection pads a1', b1', c1', d1', e1', and f1' formed at one side pa1' of the area DR1 to which the first driver integrated circuit is connected are formed.

Four second inspection wires lc2, ld2, le2, and lf2 connected to four inspection pads c2, d2, e2, and f2 of six inspection pads a2, b2, c2, d2, e2, and f2 formed at one side pa2 of the area DR2 to which the second driver integrated circuit is connected are formed.

Four second inspection wires lc2', ld2', le2', and lf2' connected to four inspection pads c2', d2', e2', and f2' of six inspection pads a2', b2', c2', d2', e2', and f2' formed at an opposite side pa2' of the area DR2 to which the second driver integrated circuit is connected are formed.

The above-described second inspection wire is on an upper side of a location of the corresponding inspection pad, and is broken at a corner of the display panel 110.

A plurality of link lines are formed between the second inspection wires formed between opposite sides of the areas DR1 and DR2 to which the driver integrated circuits are connected.

That is, six link lines da1, db1, dc1, dd1, de1, and df1 are formed between four second inspection wires lc1, ld1, le1, and lf1 formed at one side pa1 of the area DR1 to which the first driver integrated circuit is connected, and four second inspection wires lc1', ld1', le1', and lf1' formed at an opposite side pa1' of the area DR1 to which the first driver integrated circuit is connected are formed.

The six link lines da1, db1, dc1, dd1, de1, and df1 are connected to the six first lines VL1, VL2, VL3, VL4, VL5, and VL6, respectively, to correspond to the six first lines VL1, VL2, VL3, VL4, VL5, and VL6, and supplies a signal output from the first driver integrated circuit to the six first lines VL1, VL2, VL3, VL4, VL5, and VL6.

Likewise, six link lines da2, db2, dc2, dd2, de2, and df2 are formed between four second inspection wires lc2, ld2, le2, and lf2 formed at one side pa2 of the area DR2 to which the first driver integrated circuit is connected, and four second inspection wires lc2', ld2', le2', and lf2' formed at an opposite side pa2' of the area DR2 to which the first driver integrated circuit is connected are formed.

The six link lines da2, db2, dc2, dd2, de2, and df2 are connected to the six first lines VL7, VL8, VL9, VL10, VL11, and VL12, respectively, to correspond to the six first lines VL7, VL8, VL9, VL10, VL11, and VL12, and supplies a signal output from the first driver integrated circuit to the six first lines VL7, VL8, VL9, VL10, VL11, and VL12.

Here, the six inspection pads and the six inspection wires formed in the peripheral areas pa1, pa1', pa2, pa2', etc. of the areas DR1, DR2, etc. to which the driver integrated circuits (ICs) are connected are not configurations used to display an image, but are some of the configurations which have been used for an inspection of a panel during a process of manufacturing the display panel 110 and are left after the process of manufacturing the display panel (including a scribing process). This will be described in more detail with reference to FIGS. 10 and 11.

Figure 5:
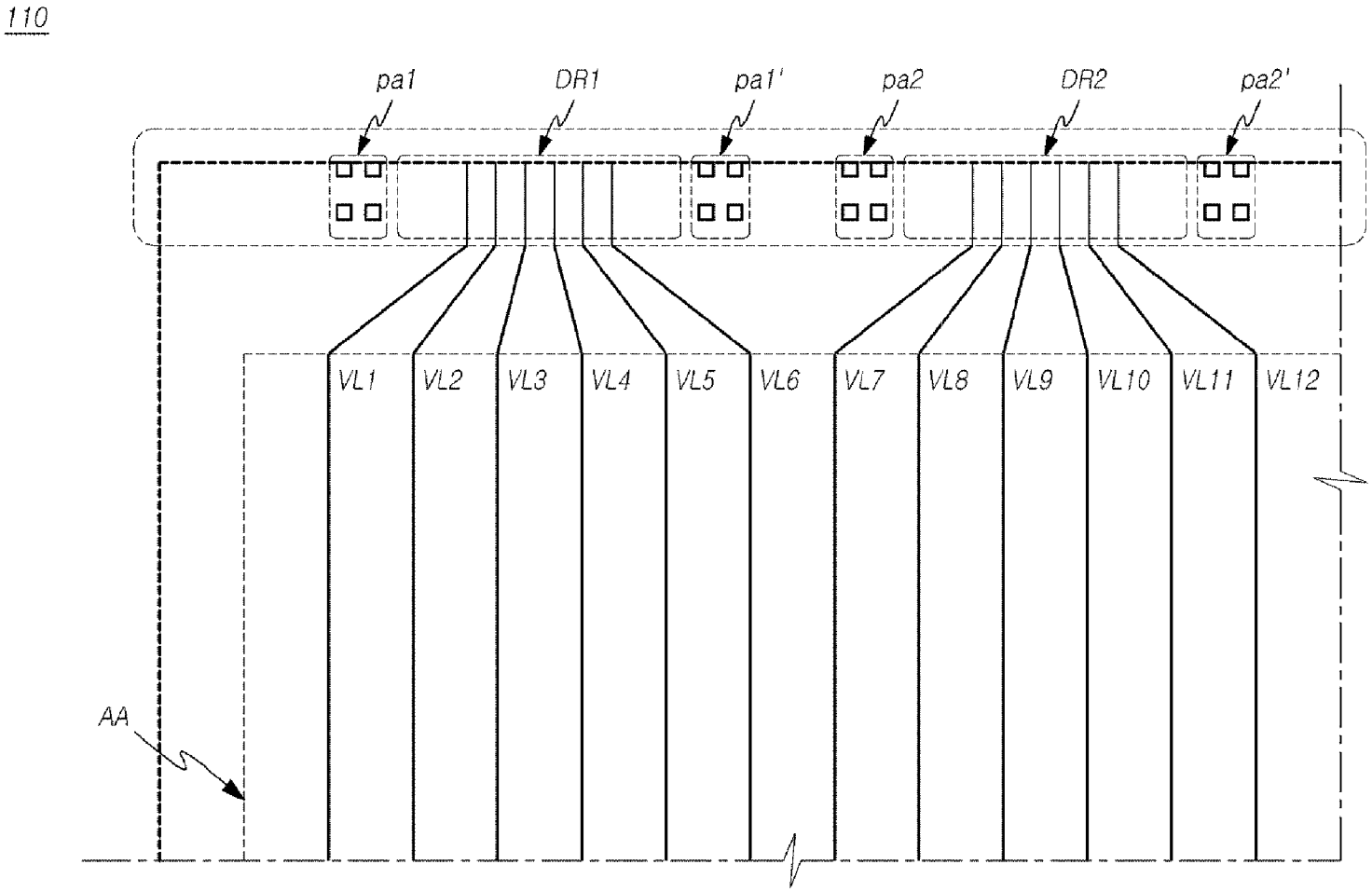
FIGS. 5 and 6 are views showing a display panel according to another embodiment of the present invention.
Figure 6:
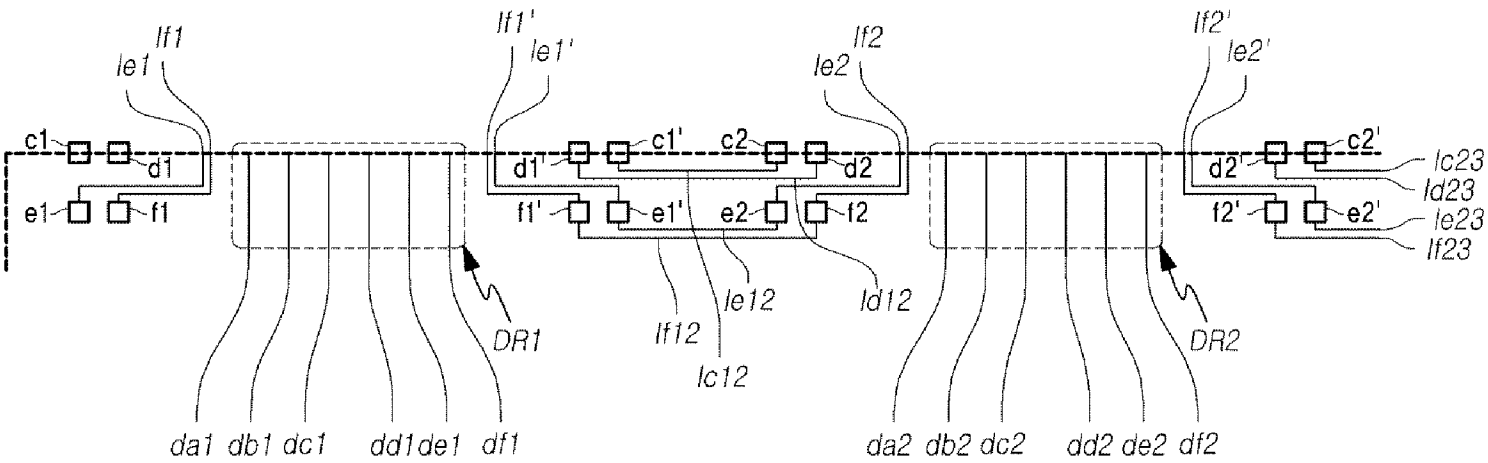

FIGS. 5 and 6 are views showing a display panel in which four inspection pads are formed in the peripheral areas pa1, pa1', pa2, and pa2' of the areas DR1 and DR2 to which the driver integrated circuits are connected will be described as another embodiment of the present invention.

FIG. 5 is a view showing a display panel 110 according to another embodiment of the present invention. FIG. 6 is an enlarged view showing a portion of FIG. 5. However, for the sake of convenience, second lines HL1, HL2, etc. are not shown and only first lines VL1, VL2, etc., formed in a first direction are shown in FIG. 5.

Referring to FIG. 5, in the display panel 110 according to the embodiment of the present invention, four inspection pads are formed in peripheral areas pa1, pa1', pa2, pa2' of areas DR1 and DR2 to which driver integrated circuits (ICs) for outputting a signal to the first lines VL1 to VLm formed in the first direction are connected.

Inspection wires may be formed in the display panel 110 in relation to the inspection pads, and the inspection wires may be first inspection wires (the first type of inspection wires), opposite ends of which are connected to different inspection pads, the opposite ends being connected between two inspection pads, and may be second inspection wires (the second type of inspection wires) connected to only one inspection pad, that is, only one end of which is connected to an inspection pad.

Hereinafter, formation of an inspection pad and an inspection wire will be described in more detail with reference to FIG. 6.

First, formation of an inspection pad will be described in more detail.

Referring to FIG. 6, four inspection pads c1, d1, e1, and f1 are formed at one side pa1 of the area DR1 to which the first driver integrated circuit is connected, and four inspection pads c1', d1', e1', and f1' are formed at an opposite side pa1' of the area DR1 to which the first driver integrated circuit is connected.

Referring to FIG. 6, four inspection pads c2, d2, e2, and f2 are formed at one side pa2 of the area DR2 to which the second driver integrated circuit is connected, and four inspection pads c2', d2', e2', and f2' are formed at an opposite side pa2' of the area DR2 to which the second driver integrated circuit is connected.

The four inspection pads formed in the peripheral areas of the areas DR1 and DR2 to which the driver integrated circuits are connected may be arranged in a single row, but as shown in FIGS. 5 and 6, may be arranged in a multiple rows.

For example, referring to FIG. 6, among the four inspection pads c1, d1, e1, and f1 formed at one side pa of the area DR1 to which the first driver integrated circuit is connected, the inspection pad c1 and the inspection pad d1 are arranged in a first row, and the inspection pad e1 and the inspection pad f1 are arranged in a second row spaced apart from the first row.

Next, formation of an inspection wire will be described in more detail.

The inspection wires formed in the display panel 110 may be one of two types including a first inspection wire, opposite ends of which are connected to different inspection pads, and a second inspection wire, only one end of which is connected to an inspection pad.

First, formation of a first inspection wire, opposite ends of which are connected to different inspection pads, will be described in more detail.

Referring to FIG. 6, four first inspection wires lc12, ld12, le12, and lf12 for connecting four inspection pads c1', d1', e1', and f1' formed at an opposite side pa1' of the area DR1 to which the first driver integrated circuit is connected, and four inspection pads c1', d1', e1', and f1' formed at one side pa2 of the area DR2 to which the second driver integrated circuit is connected, are formed.

Further, referring to FIG. 6, four first inspection wires lc23, ld23, le23, and lf23 for connecting four inspection pads c2', d2', e2', and f2' formed at an opposite side pa2' of the area DR2 to which the second driver integrated circuit is connected, and four inspection pads c3, d3, e3, and f3 formed at one side pa3 of the area DR3 to which the third driver integrated circuit is connected are formed.

The above-described first inspection wires are formed on a lower side of locations of the different pads connected to opposite ends thereof.

Formation of the second inspection wire, only one end of which are connected to an inspection pad will be described in more detail.

Referring to FIG. 6, two second inspection wires le1 and lf1 connected to two inspection pads e1 and f1 of the four inspection pads c1, d1, e1, and f1 formed at one side pa1 of the area DR1 to which the first driver integrated circuit is connected are formed.

Referring to FIG. 6, two second inspection wires le1' and lf1' connected to two inspection pads e1' and f1' of the four inspection pads c1', d1', e1', and f1' formed at an opposite side pa1' of the area DR1 to which the first driver integrated circuit is connected are formed.

Two second inspection wires le2 and lf2 connected to two inspection pads e2 and f2 of four inspection pads c2, d2, e2, and f2 formed at one side pa2 of the area DR2 to which the second driver integrated circuit is connected are formed.

Two second inspection wires le2' and lf2' connected to two inspection pads e2' and f2' of four inspection pads c2', d2', e2', and f2' formed at an opposite side pa2' of the area DR2 to which the second driver integrated circuit is connected are formed.

The above-described second inspection wire is on an upper side of a location of the corresponding inspection pad, and is broken at a corner of the display panel 110.

A plurality of link lines are formed between the second inspection wires formed between opposite sides of the areas DR1 and DR2 to which the driver integrated circuits are connected.

That is, six link lines da1, db1, dc1, dd1, de1, and df1 are formed between two second inspection wires le1 and lf1 formed at one side pa1 of the area DR1 to which the first driver integrated circuit is connected, and two second inspection wires le1' and lf1' formed at an opposite side pa1' of the area DR1 to which the first driver integrated circuit is connected are formed.

The six link lines da1, db1, dc1, dd1, de1, and df1 are connected to the six first lines VL1, VL2, VL3, VL4, VL5, and VL6, respectively, to correspond to the six first lines VL1, VL2, VL3, VL4, VL5, and VL6, and supplies a signal output from the first driver integrated circuit to the six first lines VL1, VL2, VL3, VL4, VL5, and VL6.

Likewise, six link lines da2, db2, dc2, dd2, de2, and df2 are formed between two second inspection wires le2 and lf2 formed at one side pa2 of the area DR2 to which the first driver integrated circuit is connected, and two second inspection wires le2' and lf2' formed at an opposite side pa2' of the area DR1 to which the first driver integrated circuit is connected are formed.

The six link lines da2, db2, dc2, dd2, de2, and df2 are connected to the six first lines VL7, VL8, VL9, VL10, VL11, and VL12, respectively, to correspond to the six first lines VL7, VL8, VL9, VL10, VL11, and VL12, and supplies a signal output from the first driver integrated circuit to the six first lines VL7, VL8, VL9, VL10, VL11, and VL12.

Here, the four inspection pads and the four inspection wires formed in the peripheral areas pa1, pa1', pa2, pa2', etc. of the areas DR1, DR2, etc. to which the driver integrated circuits (ICs) are connected are not configurations used to display an image, but are some of the configurations which have been used for an inspection of a panel during a process of manufacturing the display panel 110 and are left after the process of manufacturing the display panel 110 (including a scribing process). This will be described in more detail with reference to FIGS. 10 and 11.

Figure 7:
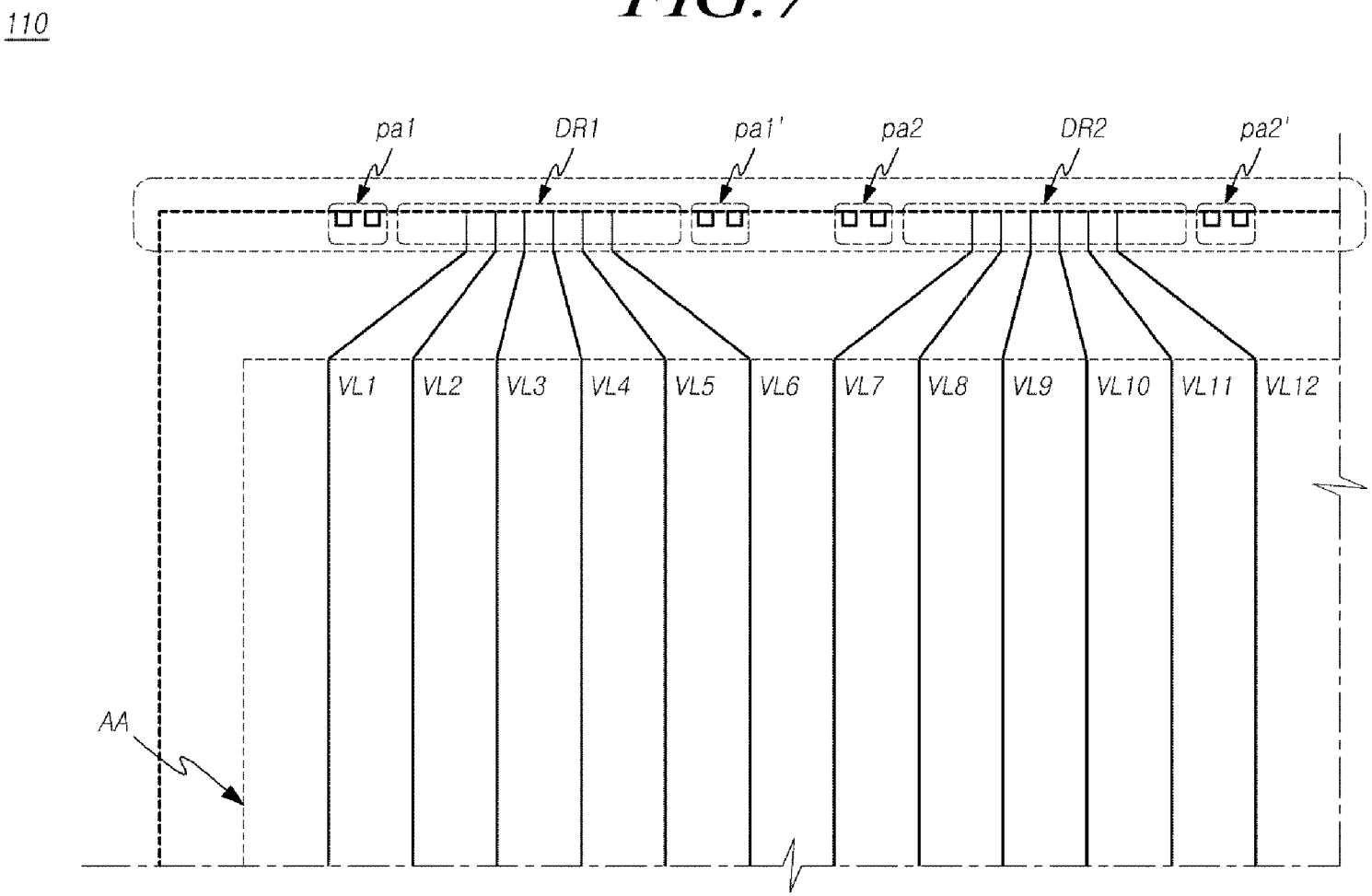
FIGS. 7 and 8 are views showing a display panel according to another embodiment of the present invention.
Figure 8:
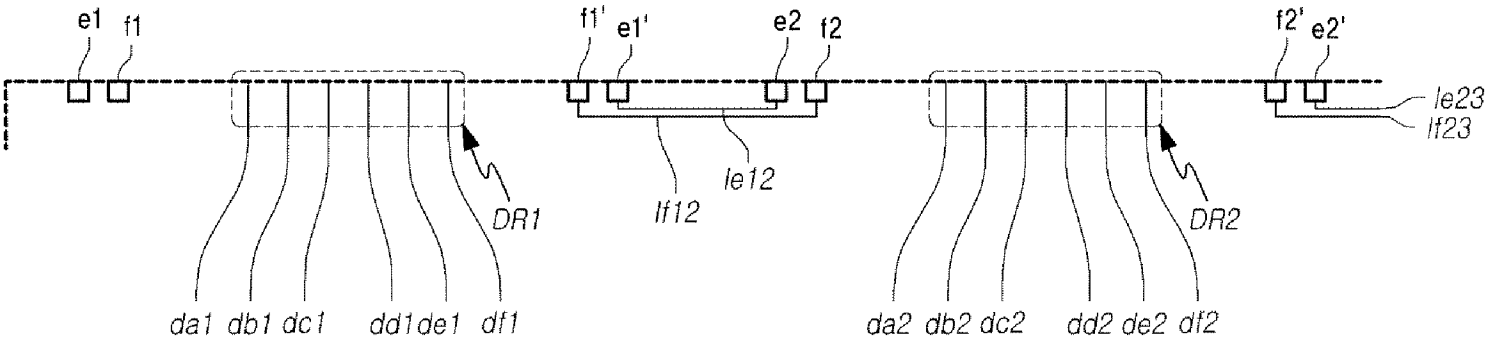

FIGS. 7 and 8 are views showing a display panel in which two inspection pads are formed in the peripheral areas pa1, pa1', pa2, and pa2' of the areas DR1 and DR2 to which the driver integrated circuits are connected, according to another embodiment of the present invention.

FIG. 7 is a view showing a display panel 110 according to another embodiment of the present invention. FIG. 6 is an enlarged view showing a portion of FIG. 5. However, for the sake of convenience, second lines HL1, HL2, etc. are not shown and only first lines VL1, VL2, etc. formed in a first direction are shown in FIG. 5.

Referring to FIG. 7, in the display panel 110 according to the embodiment of the present invention, two inspection pads are formed in peripheral areas pa1, pa1', pa2, pa2' of areas DR1 and DR2 to which driver integrated circuits (ICs) for outputting a signal to the first lines VL1 to VLm formed in the first direction are connected.

Inspection wires may be formed in the display panel 110 in relation to the inspection pads, and the inspection wires may be first inspection wires (the first type of inspection wires), opposite ends of which are connected to different inspection pads, the opposite ends being connected between two inspection pads, and may be second inspection wires (the second type of inspection wires), connected to only one inspection pad, that is, only one end of which is connected to an inspection pad.

Hereinafter, formation of an inspection pad and an inspection wire will be described in more detail with reference to FIG. 8.

First, formation of an inspection pad will be described in more detail.

Referring to FIG. 8, two inspection pads e1 and f1 are formed at one side pa1 of the area DR1 to which the first driver integrated circuit is connected, and two inspection pads e1' and f1' are formed at an opposite side pa1' of the area DR1 to which the first driver integrated circuit is connected.

Referring to FIG. 6, two inspection pads e2 and f2 are formed at one side pa2 of the area DR2 to which the second driver integrated circuit is connected, and two inspection pads e2' and f2' are formed at an opposite side pa2' of the area DR2 to which the second driver integrated circuit is connected.

The two inspection pads formed in peripheral areas of the areas DR1 and DR2 to which the driver integrated circuits may be arranged in a single row.

For example, referring to FIG. 8, two inspection pads e1 and f1 formed at one side pa of the area DR1 to which the first driver integrated circuit is connected may be arranged in a single row.

Next, formation of an inspection wire will be described in more detail.

The inspection wires formed in the display panel 110 may be one of two types including a first inspection wire, opposite ends of which are connected to different inspection pads, and a second inspection wire, only one end of which is connected to an inspection pad.

Since FIG. 8 is shown with an assumption that the substrate is transferred such that the second inspection lines le1, lf1, etc. connected to the inspection pads e1, f1, etc., shown in FIG. 8 above the inspection pads e1, f1, etc., are not left in a scribing process during a process of manufacturing the display panel 110, the type of the second inspection wire, only one end of which is connected to an inspection pad, does not appear in the display panel 110 of FIG. 8.

First, formation of a first inspection wire, opposite ends of which are connected to different inspection pads, will be described in more detail.

Referring to FIG. 8, two first inspection wires le12 and lf12 for connecting two inspection pads e1' and f1' formed at an opposite side pa1' of the area DR1 to which the first driver integrated circuit is connected, and two inspection pads e2 and f2 formed at one side pa2 of the area DR2 to which the second driver integrated circuit is connected are formed.

Further, referring to FIG. 8, two first inspection wires le23 and lf23 for connecting two inspection pads e2' and f2' formed at an opposite side pa2' of the area DR2 to which the second driver integrated circuit is connected, and two inspection pads e3, and f3 formed at one side pa3 of the area DR3 to which the third driver integrated circuit is connected are formed.

The above-described first inspection wires are formed on a lower side of locations of the different pads connected to opposite ends thereof.

As described above, since FIG. 8 is exemplarily shown with an assumption that the substrate is transferred such that the second inspection lines le1, lf1, etc. connected to the inspection pads e1, f1, etc. shown in FIG. 8 above the inspection pads e1, f1, etc. are not left in a scribing process during a process of manufacturing the display panel 110, the type of the second inspection wire, only one end of which is connected to an inspection pad does not appear in the display panel 110 of FIG. 8.

A plurality of link lines are formed between the inspection wires formed between opposite sides of the areas DR1 and DR2 to which the driver integrated circuits are connected.

That is, six link lines da1, db1, dc1, dd1, de1, and df1 are formed between two inspection pads e1 and f1 formed at one side pa1 of the area DR1 to which the first driver integrated circuit is connected, and two inspection pad e1' and f1' formed at an opposite side pa1' of the area DR1 to which the first driver integrated circuit is connected are formed.

The six link lines da1, db1, dc1, dd1, de1, and df1 are connected to the six first lines VL1, VL2, VL3, VL4, VL5, and VL6, respectively, to correspond to the six first lines VL1, VL2, VL3, VL4, VL5, and VL6, and supplies a signal output from the first driver integrated circuit to the six first lines VL1, VL2, VL3, VL4, VL5, and VL6.

Likewise, six link lines da2, db2, dc2, dd2, de2, and df2 are formed between two inspection pads e2 and f2 formed at one side pa2 of the area DR2 to which the first driver integrated circuit is connected, and two inspection pads e2' and f2' formed at an opposite side pa2' of the area DR1 to which the first driver integrated circuit is connected are formed.

The six link lines da2, db2, dc2, dd2, de2, and df2 are connected to the six first lines VL7, VL8, VL9, VL10, VL11, and VL12, respectively, to correspond to the six first lines VL7, VL8, VL9, VL10, VL11, and VL12, and supplies a signal output from the first driver integrated circuit to the six first lines VL7, VL8, VL9, VL10, VL11, and VL12.

Here, the two inspection pads and the two inspection wires formed in the peripheral areas pa1, pa1', pa2, pa2', etc. of the areas DR1, DR2, etc. to which the driver integrated circuits (ICs) are connected are not configurations used to display an image, but are some of the configurations which have been used for an inspection of a panel during a process of manufacturing the display panel 110 and are left after the process of manufacturing the display panel (including a scribing process). This will be described in more detail with reference to FIGS. 10 and 11.

Until now, a display panel in which four inspection pads are formed in the peripheral areas pa1, pa1', pa2, and pa2' of the areas DR1 and DR2 to which the driver integrated circuits are connected has been described as an embodiment of the present invention.

In the above-described embodiments, the locations of the inspection pads and the inspection wires are peripheral areas of the areas to which the driver integrated circuits are connected, and the peripheral areas may be residual spaces in which other configurations are not formed even if the inspection pads and the inspection wires are not formed. Thus, even if the inspection pads and the inspection wires for inspection of the panel are formed in an interior of the display panel 110, they do not increase the difficulty in making a narrow bezel.

As described above, the inspection pads and the inspection wires formed in the display panel 110 are initially formed in the substrate to be used for inspection of a panel during a process of manufacturing a panel and are left after the process of manufacturing the display panel 110 (including a scribing process).

The number and structures of the inspection pads and the inspection wires initially formed in the substrate to be used for inspection of a panel during a process of manufacturing a panel may vary according the pixel structure of the display panel 110.

Figure 9:
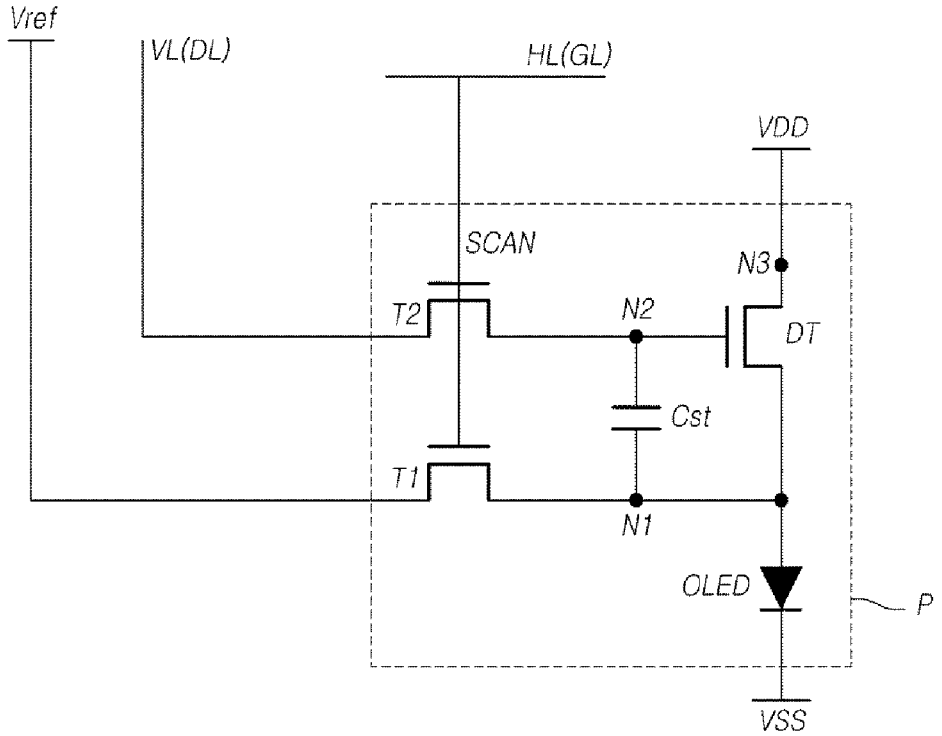
FIG. 9 is an exemplary view of a pixel structure of the display panel according to the embodiment of the present invention.
Figure 9:
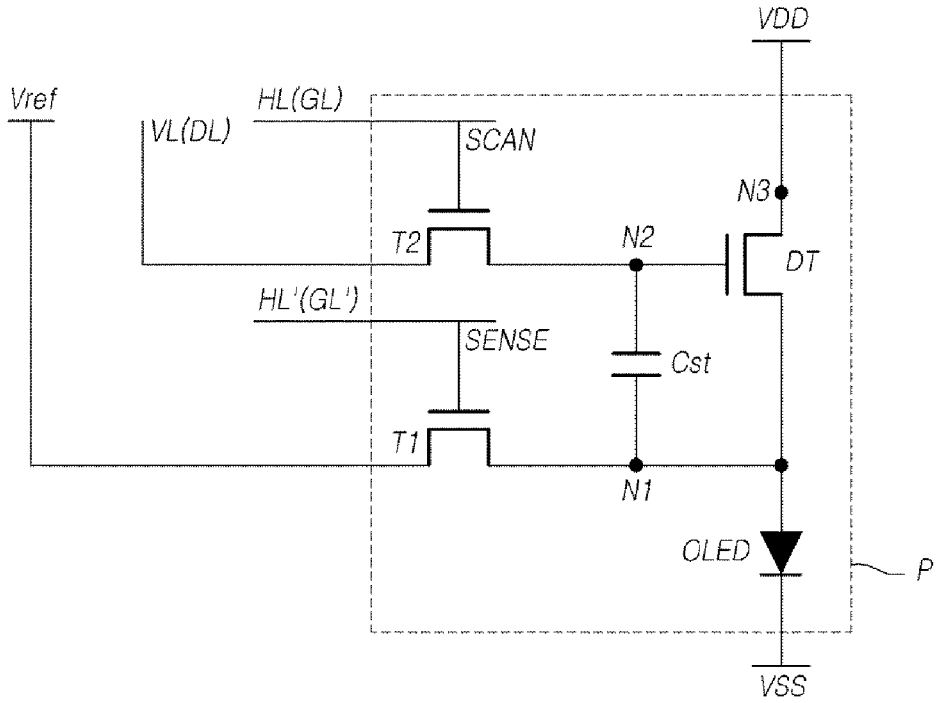

Accordingly, a pixel structure of the display panel 110 will be exemplified with reference to FIG. 9 when the display device 100 is an Organic Light Emitting Diode Display (OLED display).

FIG. 9 shows two exemplary views of the pixel structure of the display panel 110 according to an embodiment of the present invention.

Referring to FIG. 9A, each of the pixels may have a 3T1C (3 transistor, 1 capacitor) pixel structure including a driving transistor DT for supplying a current to an organic light emitting Diode (OLED), a first transistor T1 connected between a first node N1 of the driving transistor DT and a reference voltage line RVL for supplying a reference voltage, a second transistor T2 connected between a second node N2 of the driving transistor DT and a first line VL (corresponding to a data line DL), and a storage capacitor Cst connected between the first node N1 and the second node N2 of the driving transistor DT, for functioning to maintain voltages of one frame.

The first transistor T1 is controlled by a scan signal SCAN supplied through a second line HL' (also referred to as a first gate line GL) to function to apply a reference voltage Vref to the first node N1 of the driving transistor DT. The first transistor T1 may be used to sense a voltage of the first node N1 of the driving transistor DT when the corresponding pixel is operated in a sensing mode for compensation of a pixel. In this aspect, the first transistor T1 is also referred to as a sensing transistor.

The second transistor T2 is commonly controlled by a the scan signal SCAN supplied to the first transistor T1 to function to apply a data voltage Vdata which is a signal supplied through the first line VL to the second node N2 of the driving transistor DT. Turning on or off of the driving transistor Dt is determined by the data voltage applied to the second node N2 of the driving transistor DT to control, such that a current is supplied to the organic light emitting diode (OLED). In this aspect, the second transistor T2 is also referred to as a switching transistor.

The pixel structure of FIG. 3A uses two gate lines GL and GL', and the first transistor T1 and the second transistor T2 are controlled by the same gate signal SCAN through the same gate line GL. In this aspect, the pixel structure of FIG. 3A is also referred to as a one scan based pixel structure.

Referring to FIG. 9B, each of the pixels may have a 3T1C pixel structure including a driving transistor DT for supplying a current to an organic light emitting diode (OLED), a first transistor T1 connected between a first node N1 of the driving transistor DT and a reference voltage line RVL for supplying a reference voltage, a second transistor T2 connected between a second node N2 of the driving transistor DT and a first line VL (corresponding to a data line DL), and a storage capacitor Cst connected between the first node N1 and the second node N2 of the driving transistor DT, for functioning to maintain voltages of one frame.

The first transistor T1 is controlled by a first scan signal SENSE supplied through a second line HL' (also referred to as a first gate line GL) to function to apply a reference voltage Vref to the first node N1 of the driving transistor DT. The first transistor T1 may be used to sense a voltage of the first node N1 of the driving transistor DT when the corresponding pixel is operated in a sensing mode for compensation of a pixel. In this aspect, the first transistor T1 is also referred to as a sensing transistor.

The second transistor T2 is controlled by a second scan signal SCAN supplied through another second line HL (also referred to as a second gate line GL) to function to apply a data voltage Vdata which is a signal supplied through the first line VL to the second node N2 of the driving transistor DT. Turning on or off of the driving transistor DT is determined by the data voltage applied to the second node N2 of the driving transistor DT to control such that a current is supplied to the organic light emitting diode (OLED). In this aspect, the second transistor T2 is also referred to as a switching transistor.

The pixel structure of FIG. 3B uses two gate lines GL and GL', and the first transistor T1 and the second transistor T2 are controlled by different gate signal SENSE and SCAN through different gate lines GL and GL'. In this aspect, the pixel structure of FIG. 3B is also referred to as a two scan based pixel structure.

When each of the pixels has a two scan based pixel structure, the second driving unit 130 shown in FIG. 1 may be divided into a gate driving unit for outputting a scan signal and a gate driving unit for outputting a sensing signal and n second lines HL1 to HLn may be divided into gate lines HL1 to HLn for supplying a scan signal and gate lines HL' to HLn' for supplying a sensing signal.

Hereinafter, a process of manufacturing a display panel 110 with a pixel structure of FIG. 9A or FIG. 9B, an inspection of a panel performed during the process, and a panel inspection structure for the inspection will be described with reference to FIGS. 10 and 11.

Prior to the description thereof, the type and number of inspection pads will be described first.

Considering only a first direction (vertical direction), the pixel having a pixel structure shown in FIGS. 9A and 9B receives a signal (data voltage) through a first line VL, receives a reference voltage Vref through a reference voltage line, and receives a driving voltage VDD through a driving voltage line.

Thus, during a panel manufacturing process, it is necessary to supply a signal (data voltage) through a first line, supply power sources such as a reference voltage Vref and a driving voltage VDD, and inspect a pixel driving state due to the supplies.

When the pixel having a pixel structure shown in FIGS. 9A and 9B is one of a red pixel, a green pixel, a blue pixel, and a white pixel, that is, when the display device 100 has a RGBW pixel structure, it is necessary to supply signals for various colors and inspect a pixel driving state due to the supplies.

Thus, four data line inspection pads are provided for supplying data voltages for four color (R, G, B, and W) pixels and inspecting a pixel driving state due to the supply, and two power line inspection pads are provided for supplying electric power to two power sources Vref and VDD and inspecting a pixel driving state due to the supplies.

Figure 10:
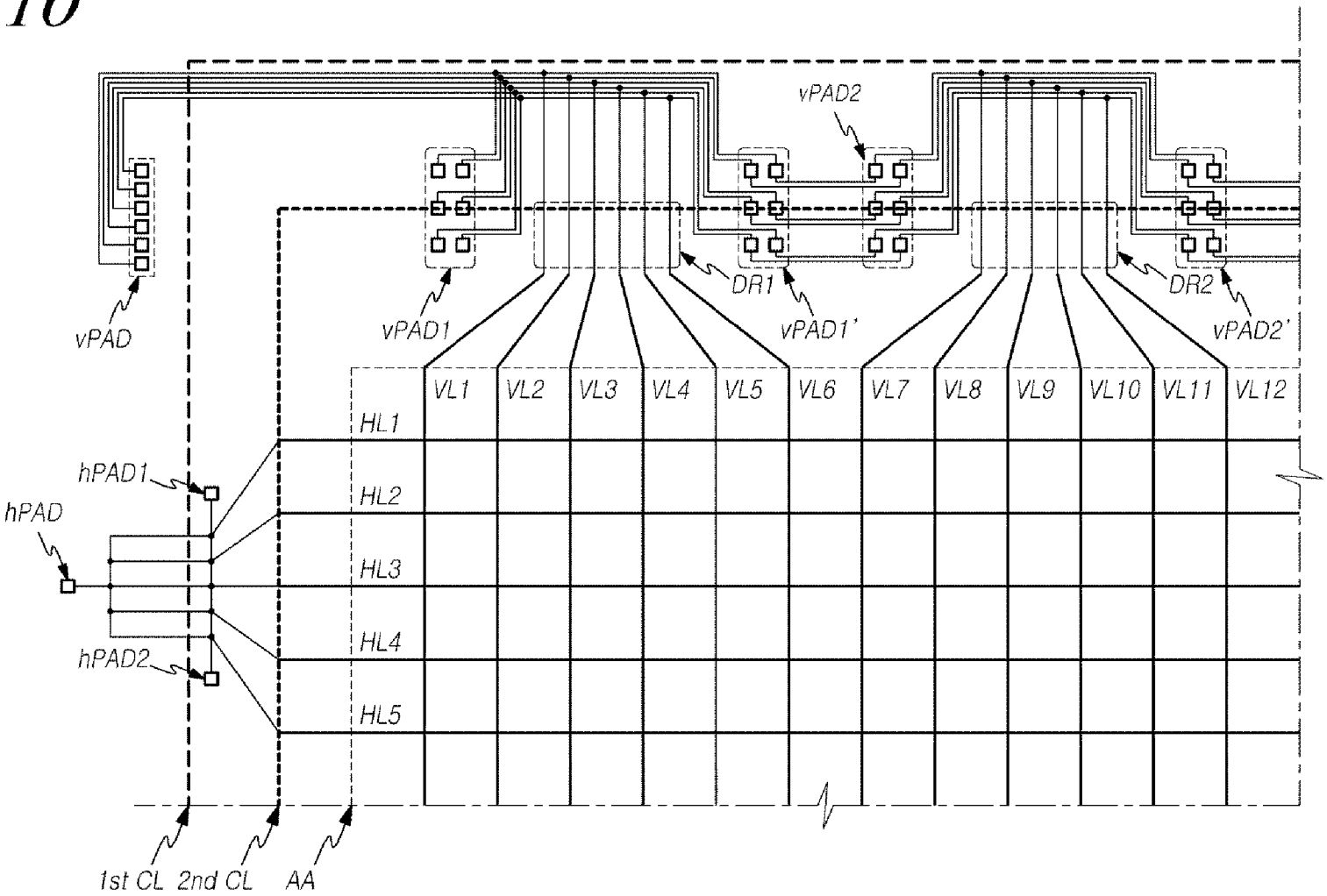
FIG. 10 is a view for explaining a method of manufacturing a display panel in relation to an inspection of the display panel.

FIG. 10 is a view for explaining a method of manufacturing a display panel 110 in relation to an inspection of the panel. FIG. 11 is an enlarged view showing an upper portion of FIG. 10.

Figure 11:
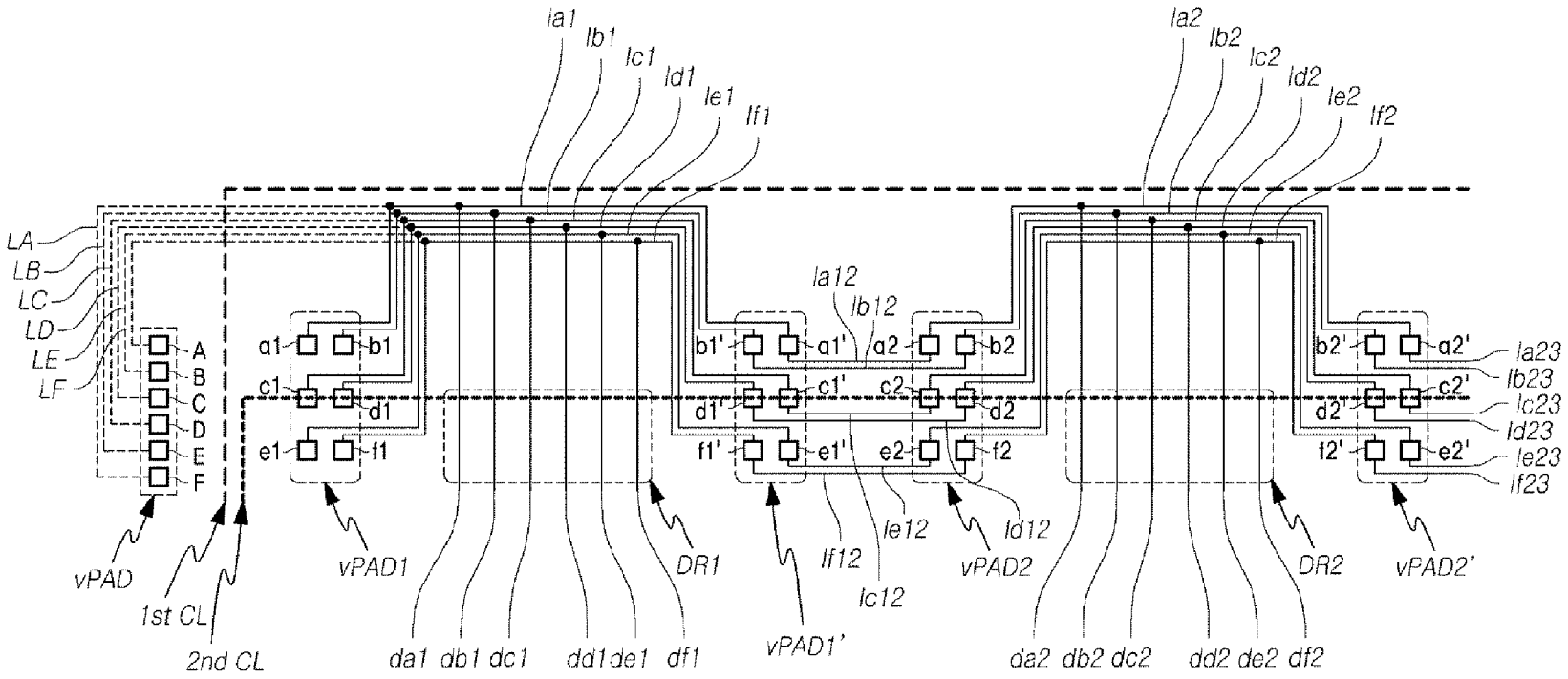
FIG. 11 is an enlarged view showing an upper portion of FIG. 10.

Referring to FIGS. 10 and 11, one large substrate by which several display panels 110 may be manufactured at the same time.

Six integrated inspection pads vPAD={A, B, C, D, E, and F} for an integrated inspection related to a first line VL are formed in a first direction (vertical direction) in units of display panels in one substrate. Then, one integrated inspection pad hPAD for an integrated inspection related to a second line HL is formed in a second direction (horizontal direction). In some embodiments, the six integrated inspection pads vPAD and the integrated inspection pad hPAD may be formed together.

Thereafter, six inspection pads for performing individual inspections related to a first line VL formed in a first direction (vertical direction) for data driving integrated circuits are formed at opposite sides of areas to which two or more data driving integrated circuits are connected, in units of display panels in one substrate.

In more detail, referring to FIGS. 10 and 11, six inspection pads vPAD1={a1, b1, c1, d1, e1, and f1} are formed at one side of the area DR1 to which the first data driving integrated circuit is to be connected is formed and six inspection pads vPAD1'={a1', b1', c1', d1', e1', and f1'} are formed at an opposite side of the area DR2 to which the first data driving integrated circuit is to be connected is formed.

Likewise, six inspection pads vPAD1={a2, b2, c2, d2, e2, and f2} are formed at one side of the area DR1 to which the second data driving integrated circuit is to be connected is formed and six inspection pads vPAD2'={a2', b2', c2', d2', e2', and f2'} are formed at an opposite side of the area DR2 to which the second data driving integrated circuit is to be connected is formed.

Then, two or more integrated inspection pads hPAD1 and hPAD2 for individual inspections related to a second line HL formed in a second direction (horizontal direction) may be formed together.

Six inspection pads formed at opposite sides of the areas DR1 and DR2 to which two or more data driving integrated circuits are to be connected are connected to each other to correspond to each other in units of display panels in one substrate, and two or more second inspection wires contacting a link line connected to the first line are formed at an intermediate portion.

Referring to FIGS. 10 and 11, six inspection pads vPAD1={a1, b1, c1, d1, e1, and f1} are formed at one side of the area DR1 to which the first data driving integrated circuit is to be connected is formed, and six second inspecting wires la1, lb1, lc1, ld1, le1, and lf1 connecting six inspection pads vPAD1'={a1', b1', c1', d1', e1', and f1'} such that the inspection pad vPAD1' correspond to each other are formed at an opposite side of the area DR2 to which the first data driving integrated circuit is to be connected is formed.

The six second inspection wires la1, lb1, lc1, ld1, le1, and lf1 contact link lines da1, db1, dc1, dd1, de1, and df1 for connecting six first lines VL1, VL2, VL3, VL4, VL5, and VL6 corresponding to six data lines DL to the first data driving integrated circuit, at intermediate points, respectively.

Likewise, six inspection pads vPAD1={a2, b2, c2, d2, e2, and f2} are formed at one side of the area DR1 to which the second data driving integrated circuit is to be connected is formed, and six second inspecting wires la2, lb2, lc2, ld2, le2, and lf2 connecting six inspection pads vPAD2'={a2', b2', c2', d2', e2', and f2'} such that the inspection pad vPAD2' correspond to each other are formed at an opposite side of the area DR2 to which the first data driving integrated circuit is to be connected is formed.

The six second inspection wires la2, lb2, lc2, ld2, le2, and lf2 contact link lines da2, db2, dc2, dd2, de2, and df2 for connecting six first lines VL7, VL8, VL9, VL10, VL11, and VL12 corresponding to six data lines DL to the first data driving integrated circuit, at intermediate points, respectively.

Two or more first inspection wires for connecting two or more inspection pads formed at an opposite side of an area to which one of two or more data driving integrated circuits is to be connected and two or more inspection pads formed at one side of an area to which the other of the two data driving integrated circuits is to be connected such that they correspond to each other are formed in units of display panels in one substrate.

Referring to FIGS. 10 and 11, six first inspection wires la12, lb12, lc12, ld12, le12, and lf12 for connecting six inspection pads vPAD1'={a1', b1', c1', d1', e1', and f1'} formed at an opposite side of the area DR1 to which the first data driving integrated circuit is to be connected, and six inspection pads vPAD2={a1, b1, c1, d1, e1, and f1} formed at one side of the area DR2 to which the second data driving integrated circuit is to be connected are formed.

Likewise, six first inspection wires la23, lb23, lc23, ld23, le23, and lf23 for connecting six inspection pads vPAD2'={a2', b2', c2', d2', e2', and f2'} formed at an opposite side of the area DR2 to which the second data driving integrated circuit is to be connected, and six inspection pads vPAD3={a3, b3, c3, d3, e3, and f3} formed at one side of the area DR3 to which the third data driving integrated circuit is connected are formed.

Two or more second inspection wires la1 lb1, lc1, ld1, le1, and lf1 for connecting six inspection pads a1/b1/c1/d1/de/f1-a2/b2/c2/d2/e2/f2 formed at opposite sides of the area DR1 to which a data driving integrated circuit to be connected to an outermost side is to be connected and six integrated inspection wires LA, LB, LC, LD, LE, and LF for connecting six integrated inspection pads vPAD={A, B, C, D, E, and F} are formed in units of display panels in one substrate.

As described above, thin film transistors (TFTs) are formed in active areas (A/A) at a time point when the inspection pads and the inspection wires are formed in units of display panels.

After all the inspection structures (inspection pads and inspection wires) are formed and all the thin film transistors are formed, an integrated inspection signal is applied through six integrated inspection pads vPAD={A, B, C, D, E, and F} to perform an integrated inspection.

The integrated inspection may be performed in units of display panels, and all the integrated inspection wires LA, LB, LC, LD, LE, and LF may be short-circuited between the display panels such that the integrated inspection is performed in the entire substrate.

If there is no problem after the integrated inspection, a preparation panel (a step before a display panel is finished) is prepared by cutting a substrate along a first cutting line 1st CL by using scribing equipment. Then, six integrated inspection pads vPAD={A, B, C, D, E, and F} and six integrated inspection wires LA, LB, LC, LD, LE, and LF are partially removed.

On the preparation panels manufactured in this way, individual inspections are performed by applying individual inspection signals to six inspection pads formed at opposite sides of the areas DR1 and DR2 to which two or more data driving integrated circuits are to be connected, respectively.

The individual inspections may be performed after cells of a liquid crystal display (LCD) or an organic light emitting diode display (OLED display) are made If there is no problem after the individual inspections, a panel having a size large enough to be inserted into the display device 100 is manufactured by cutting a preparation panel along a second cutting line 2nd CL by using scribing equipment. The display panel 110 described with reference to FIGS. 1 to 8 is manufactured by using the panel.

Then, one of the display panel 110 according to the embodiment of FIGS. 3 and 4, the display panel 110 according to the embodiment of FIGS. 5 and 6, and the display panel 110 according to the embodiment of FIGS. 7 and 8 may be manufactured according to a location of the second equipment line 2nd CL.

In addition to the display panel 110 according to the embodiment of FIGS. 3 and 4, the display panel 110 according to the embodiment of FIGS. 5 and 6, and the display panel 110 according to the embodiment of FIGS. 7 and 8, various other types of display panels 110 may be manufactured by adjusting a location of the second cutting line 2nd CL.

The locations of the inspection pads and the inspection wires are peripheral areas of the areas to which the driver integrated circuits are connected, and the peripheral areas may be residual spaces in which other configurations are not formed even if the inspection pads and the inspection wires are not formed.

Thus, even if the inspection pads and the inspection wires for inspection of the panel are formed in an interior of the display panel 110, they do not act as obstacles in realizing a narrow bezel. Instead, a separation between display panel units on a substrate may be narrowed to help manufacture many display panels.

As described above, a display panel 110 and a display device 100 are configured such that all or some portions of an inspection pad and an inspection wire for inspection of a panel are formed in the display panel.

Further, according to the present invention, a display panel 110 and a display device 100 are configured such that all or some portions of an inspection pad and an inspection wire for inspection of a panel are formed in the display panel due to a structure which allows a narrow bezel (a unified connection structure of inspection wires, a multiple row structure of inspection pads).

In addition, according to the present invention, a display panel 110 and a display device 100 are configured such that all or some portions of an inspection pad and an inspection wire for inspection of a panel are formed in the display panel due to a structure which allows a narrow bezel such that panel manufacturing efficiency and yield rate are improved.

The description and the attached drawings are provided only to exemplarily describe the technical spirit of the present invention, and it will be appreciated by those skilled in the art to which the present invention pertains that the present invention may be variously corrected and modified, for example, by coupling, separating, replacing, and changing the elements. Therefore, the embodiments disclosed in the present invention are intended to illustrate the scope of the technical idea of the present invention, and the scope of the present invention is not limited by the embodiment. The scope of the present invention shall be construed on the basis of the accompanying claims in such a manner that all of the technical ideas included within the scope equivalent to the claims belong to the present invention.

What is claimed is:

1. A display device comprising:

two or more driver integrated circuits for outputting a signal for display of an image; and a display panel comprising two or more inspection pads arranged between two of the two or more driver integrated circuits and at least one inspection wire arranged between two of the two or more driver integrated circuits, wherein a first end of a first inspection wire is connected to a first inspection pad of the two or more inspection pads and a second end of the first inspection wire, opposite to the first end of the first inspection wire, is connected to a second inspection pad of the two or more inspection pads, and wherein the first inspection pad, the second inspection pad, and the first inspection wire are not used to drive the finally finished display device.

2. The display device of claim 1, wherein the first inspection wire is arranged between locations of the different inspection pads and a peripheral location of an active area of the display panel.

3. The display device of claim 1, wherein the display panel further comprises a second inspection wire arranged between two of the two or more driver integrated circuits, wherein a first end of the second inspection wire is connected to an inspection pad of the two or more inspection pads and a second end of the second inspection wire, opposite the first end of the second inspection wire, is not connected to an inspection pad of the two or more inspection pads.

4. The display device of claim 3, wherein the second inspection wire is arranged between the inspection pad connected to the second inspection wire and a corner location of the display panel.

5. The display device of claim 4, wherein the second end of the second inspection wire is broken at a corner of the display panel.

6. The display device of claim 3, wherein a plurality of link lines are arranged between the second inspection wire or the inspection pads arranged between the two of the two or more driver integrated circuits.

7. The display device of claim 3, wherein the display panel further comprises a third inspection pad, wherein the third inspection pad is not connected to the first inspection wire or the second inspection wire.

8. The display device of claim 1, wherein the two or more inspection pads are arranged in a single row.

9. The display device of claim 1, wherein the two or more inspection pads are arranged in multiple rows.

10. The display device of claim 1, wherein the first end of the first inspection wire is directly connected to the first inspection pad of the two or more inspection pads, and the second end of the first inspection wire is directly connected to the second inspection pad of the two or more inspection pads.

11. A display panel comprising:

a first line arranged in a first direction;

a second line arranged in a second direction;

two or more inspection pads arranged between two driver integrated circuits; and at least one first inspection wire arranged between the two driver integrated circuits, wherein a first end of the first inspection wire is connected to a first inspection pad of the two or more inspection pads and a second end of the first inspection wire, opposite to the first end of the first inspection wire, is connected to a second inspection pad of the two or more inspection pads, and wherein the first inspection pad, the second inspection pad, and the first inspection wire are not used to drive the finally finished display panel.

12. The display panel of claim 11, wherein the first end of the first inspection wire is directly connected to the first inspection pad of the two or more inspection pads, and the second end of the first inspection wire is directly connected to the second inspection pad of the two or more inspection pads.

13. The display panel of claim 11, wherein the first inspection wire is arranged between locations of the different inspection pads and a peripheral location of an active area of the display panel.

14. The display panel of claim 11, further comprising a second inspection wire arranged between two of the two or more driver integrated circuits, wherein a first end of the second inspection wire is connected to an inspection pad of the two or more inspection pads and a second end of the second inspection wire, opposite the first end of the second inspection wire, is not connected to an inspection pad of the two or more inspection pads.

15. The display panel of claim 14, wherein the second inspection wire is arranged between the inspection pad connected to the second inspection wire and a corner location of the display panel.

16. The display panel of claim 15, wherein the second end of the second inspection wire is broken at a corner of the display panel.

17. The display panel of claim 14, wherein a plurality of link lines are arranged between the second inspection wire or the inspection pads arranged between the two of the two or more driver integrated circuits.

18. The display panel of claim 14, wherein the display panel further comprises a third inspection pad, wherein the third inspection pad is not connected to the first inspection wire or the second inspection wire.

19. The display panel of claim 11, wherein the two or more inspection pads are arranged in a single row.

20. The display panel of claim 11, wherein the two or more inspection pads are arranged in multiple rows.

* * * * *